US008573740B2

(12) United States Patent
Rivas et al.

(10) Patent No.: US 8,573,740 B2
(45) Date of Patent: Nov. 5, 2013

(54) MANUFACTURE OF A PRINT HEAD

(75) Inventors: Rio Rivas, Corvallis, OR (US); Robert Messenger, Corvallis, OR (US); Becky Clark, Corvallis, OR (US); Rob Pugliese, Tangent, OR (US); Siddhartha Bhowmik, Salem, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/640,239

(22) PCT Filed: Apr. 9, 2010

(86) PCT No.: PCT/US2010/030594

§ 371 (c)(1), (2), (4) Date: Oct. 9, 2012

(87) PCT Pub. No.: WO2011/126493

PCT Pub. Date: Oct. 13, 2011

(65) Prior Publication Data

US 2013/0027471 A1 Jan. 31, 2013

(51) Int. Cl.
*B41J 2/135* (2006.01)

(52) U.S. Cl.
USPC ..... 347/45; 347/47

(58) Field of Classification Search
USPC ..... 347/40, 45–47, 65, 67
See application file for complete search history.

(56) References Cited

U.S. PATENT DOCUMENTS

| | | | | |
|---|---|---|---|---|
| 5,378,504 | A * | 1/1995 | Bayard et al. | 427/377 |
| 7,226,149 | B2 | 6/2007 | Stout et al. | |
| 8,128,201 | B2 * | 3/2012 | Okamura et al. | 347/45 |
| 2001/0033309 | A1 | 10/2001 | Daddey et al. | |
| 2004/0179064 | A1 | 9/2004 | Zapka et al. | |
| 2008/0158305 | A1 | 7/2008 | Cha et al. | |

OTHER PUBLICATIONS

International Search Report, PCT/US2010/030594, filed Apr. 9, 2010, dated Dec. 22, 2010, English.

* cited by examiner

*Primary Examiner* — Thinh Nguyen

(57) ABSTRACT

Manufacturing method for an inkjet print head, comprising forming a nozzle layer onto a substrate, depositing an LSE (low surface energy) coating onto the nozzle layer, depositing a sacrificial film onto the LSE coating, post processing the substrate, and removing the sacrificial film from the LSE coating, the LSE coating having a water contact angle of at least 50° after removal of the sacrificial film.

15 Claims, 6 Drawing Sheets

MANUFACTURE OF A PRINT HEAD

BACKGROUND OF THE INVENTION

It is known that in some print heads, and in particular inkjet print heads, nozzle layers are provided with LSE (low surface energy) layers on the nozzle surfaces. Such LSE coatings provide for a high contact angle of ink on the nozzle layer surface. Consequently, the LSE coatings reduce the size of puddles and minimize ink mixing on the nozzle surface between the nozzles, which may for example occur because of ink sputtering near one or multiple nozzles or because of other reasons. It appears that during manufacturing of the nozzles, chambers and/or slots of the print head, certain post processing methods such as ashing or etching can negatively decrease the contact angle of the LSE coating.

BRIEF DESCRIPTION OF THE DRAWINGS

For the purpose of illustration, certain embodiments of the present invention will now be described with reference to the accompanying diagrammatic drawings, in which.

DETAILED DESCRIPTION

In the following detailed description, reference is made to the accompanying drawings. The embodiments in the description and drawings should be considered illustrative and are not to be considered as limiting to the specific embodiment of element described. Multiple embodiments may be derived from the following description through modification, combination or variation of certain elements. Furthermore, it may be understood that also embodiments or elements that may not be specifically disclosed in this disclosure may be derived from the description and drawings.

Figure 1:
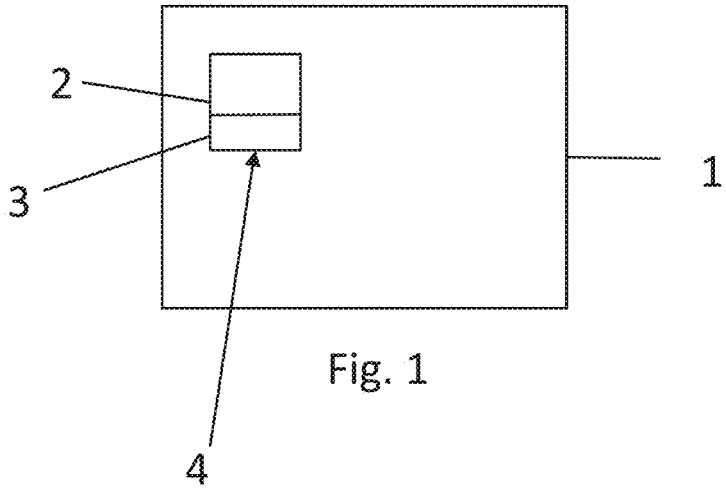
FIG. 1 shows a diagrammatic cross-sectional front view of an embodiment of a printer with a print head.

FIG. 1 shows a diagram of a printer 1. The printer 1 may comprise an inkjet printer. The printer 1 may be arranged to be connected to a computer and/or network, or may be embedded in a further system, such as a copy and/or scanning device, and/or a 3D printing device. In the shown embodiment, the printer 1 comprises a scanning print head 2 provided with a nozzle layer 3 having a nozzle surface 4 with nozzles 5 (FIG. 2) for guiding fluid out of the print head 2. In certain embodiments, the print head 2 may for example comprise a page wide array print head.

The print head 2 may comprise an inkjet print head 2 and/or any type of fluid shooting print head 2. The print head 2 may comprise actuators for stimulating the ejection of the fluid through the nozzles 5. For example, the actuators may comprise resistors 7 for heating the fluid, or piezo-actuators.

Figure 2:
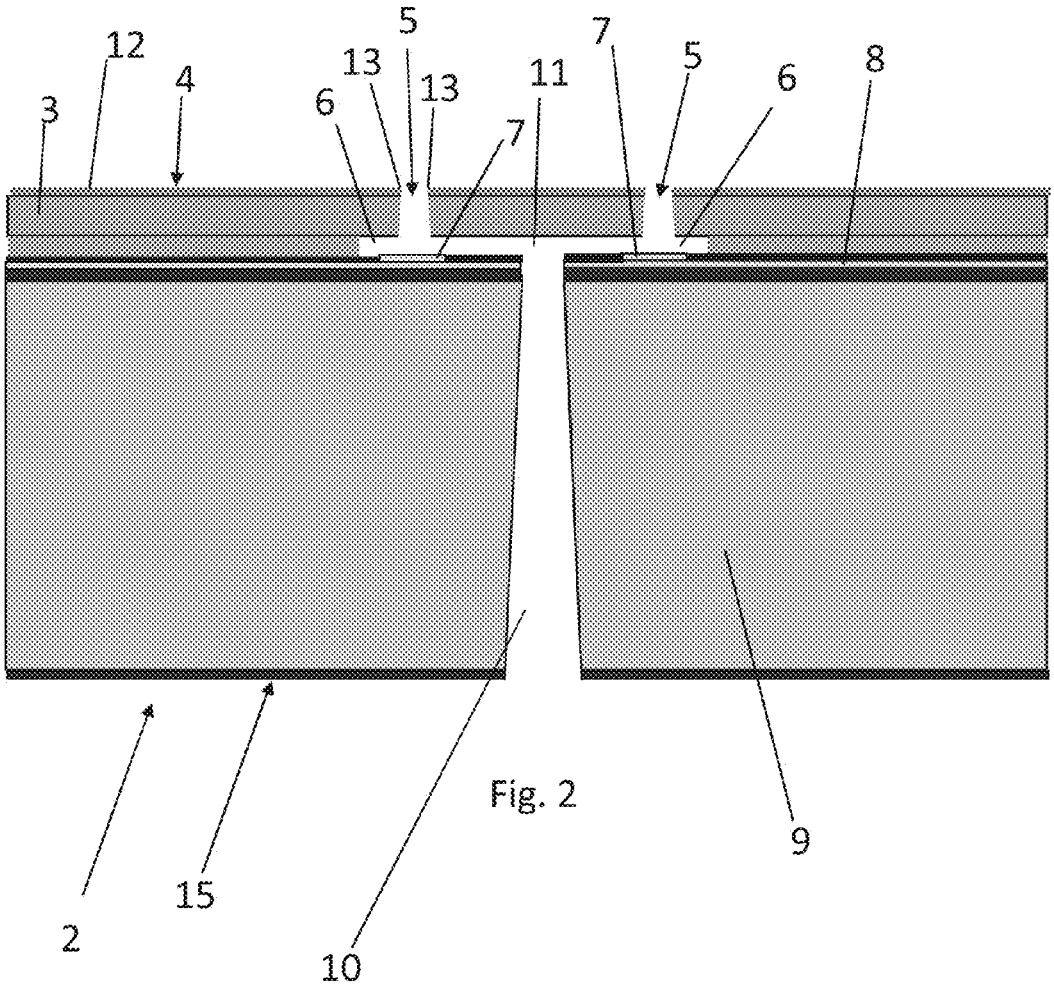
FIG. 2 shows a diagrammatic cross-sectional side view of an embodiment of a printhead.

FIG. 2 shows an embodiment of a portion of a print head 2. The print head 2 comprises a nozzle layer 3, comprising a nozzle surface 4 and nozzles 5. In an embodiment, the nozzle layer 3 may include any suitable material that is capable of withstanding prolonged exposure to inkjet inks. Such material may include a photo-imageable epoxy, such as SU8 (diglycidyl ether bisphenol A (DGEBA) based negative photoresist), photo-imageable polysiloxane based chemistries such as polyset, photo-imageable polyimides, polynorbornenes and/or the like and/or any combination of the foregoing.

The nozzle layer 3 may comprise nozzles 5 for ejecting the fluid onto media. The fluid may comprise a colorant such as ink. The colorant may comprise any color, such as cyan, magenta, yellow and black, as well as white, grey or black, and/or any combination of these. The nozzle layer 3 may comprise fluid chambers 6 in connection with the respective nozzles 5. One or more fluid chambers 6 may be connected to one or more nozzles 5. In the shown example one fluid chamber 6 is arranged to provide fluid to one corresponding nozzle 5. In or near the fluid chambers 6, resistors 7 may be provided for stimulating the fluid in the fluid chambers 6. The resistor 7 may be arranged to heat the fluid in the chambers 6 so as to eject the fluid through the respective nozzles 5. The resistors 7 may be provided near and/or in the bottom of the chamber 6. The bottom of the chamber 6 may be provided with thin film layers 8 which may include circuitry for driving the resistors 7.

The print head 2 may comprise a substrate 9 onto which the nozzle layer 3 is applied, for example grown or deposited. For the purpose of this description, the nozzle layer 3 may be regarded as part of the substrate 9. A fluid feed channel 10 may extend through the substrate 9. The fluid feed channel 10 may extend from a back side 15 of the substrate 9 to a level of the chambers 6. The fluid feed channel 10 may be connected to the chambers 6. In the shown embodiment, the fluid feed channel 10 extends between the back side 15 of the substrate 9 and an intermediate channel 11, from where the fluid may be delivered to one or more chambers 6.

A low surface energy (LSE) coating 12 may be provided onto the nozzle surface 4. The LSE coating 12 may inhibit potentially undesirable interactions between the fluid and the nozzle surface 4 such as nozzle clogging, puddle formation, mixture of fluids, or the like, because of its relatively high contact angle with liquids such as water or ink, i.e. its hydrophobic characteristics. The LSE coating 12 may have a water contact angle of at least approximately 50°, for example between approximately 50° and approximately 130°. The LSE coating 12 may have water contact angle of between approximately 70° and approximately 120°, for example between approximately 80° and approximately 110°. It is noted that the contact angle of inks or other colorants may be in similar ranges as water or may have lower or higher ranges depending on the ink surface tension. In an embodiment, the ink surface tension may be lower than water.

The LSE coating 12 may extend on the nozzle surface 4 between the nozzles 5. The LSE coating 12 may be provided on top of the nozzle layer 3 and comprise openings near the nozzles 5. The LSE coating 12 may also be deposited over edges 13 of the nozzles 5, and/or for a small distance inside of the nozzles 5, to prevent undesirable interactions of one or more fluids near these edges 13. The LSE coating 12 may comprise a hard baked film. The LSE coating 12 may comprise one or more epoxy resin layers. The LSE coating 12 may comprise polysiloxane-acrylate.

Figure 3:
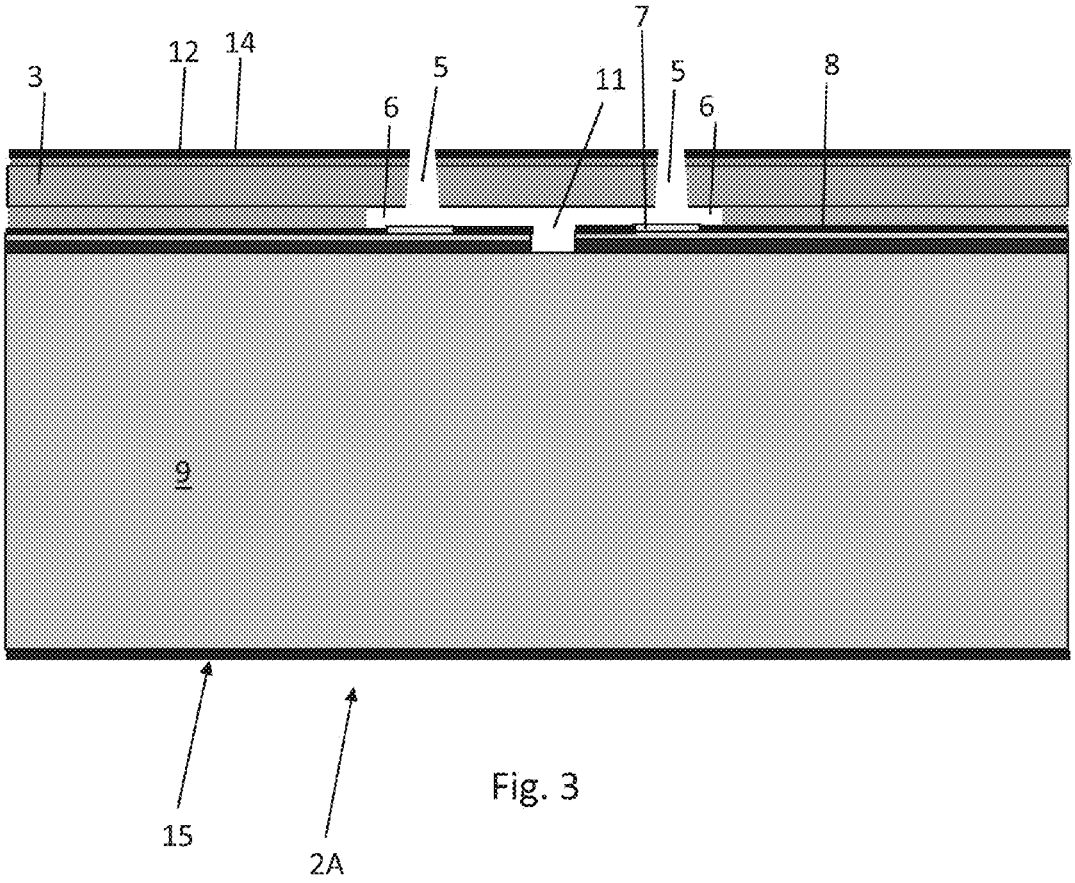
FIG. 3 shows a diagrammatic cross-sectional side view of an embodiment of an intermediary printhead.
Figure 4:
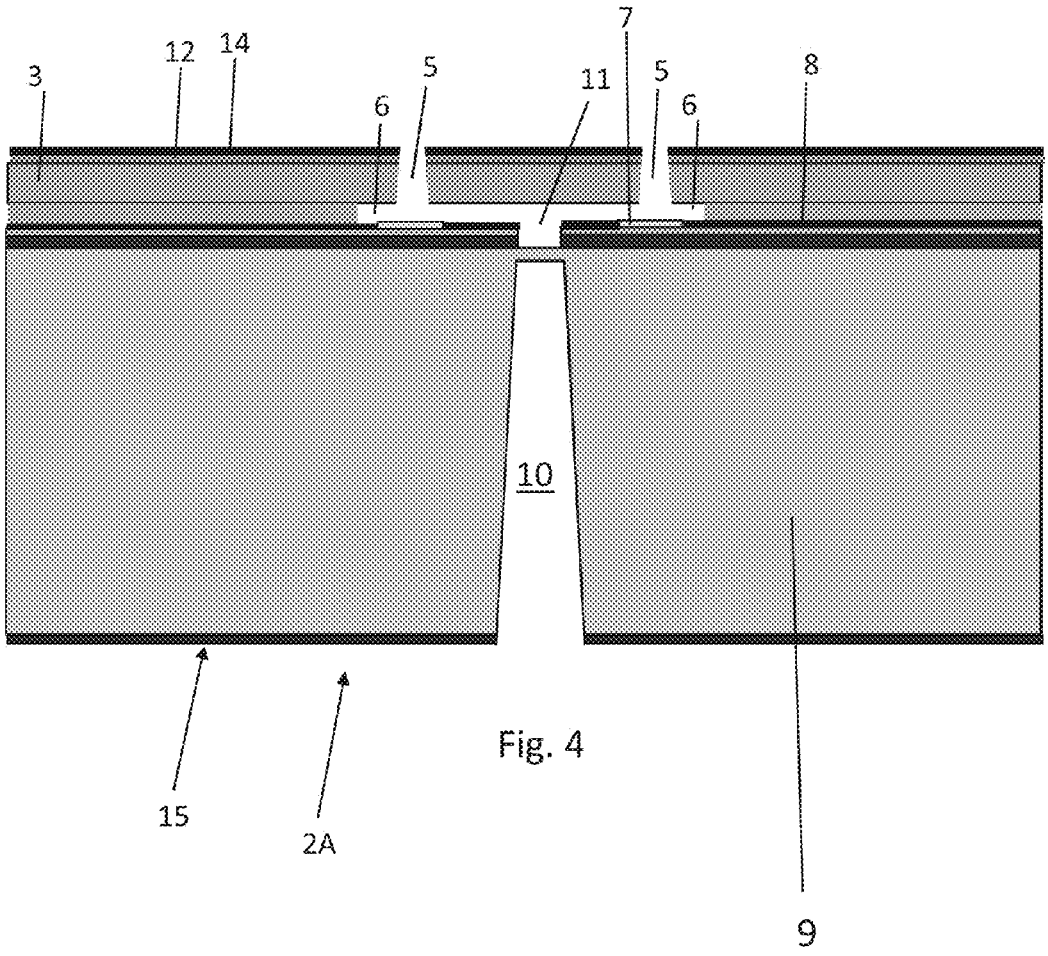
FIG. 4 shows a further diagrammatic cross-sectional side view of an embodiment of an intermediary printhead, after partial formation of the fluid feed channel.
Figure 5:
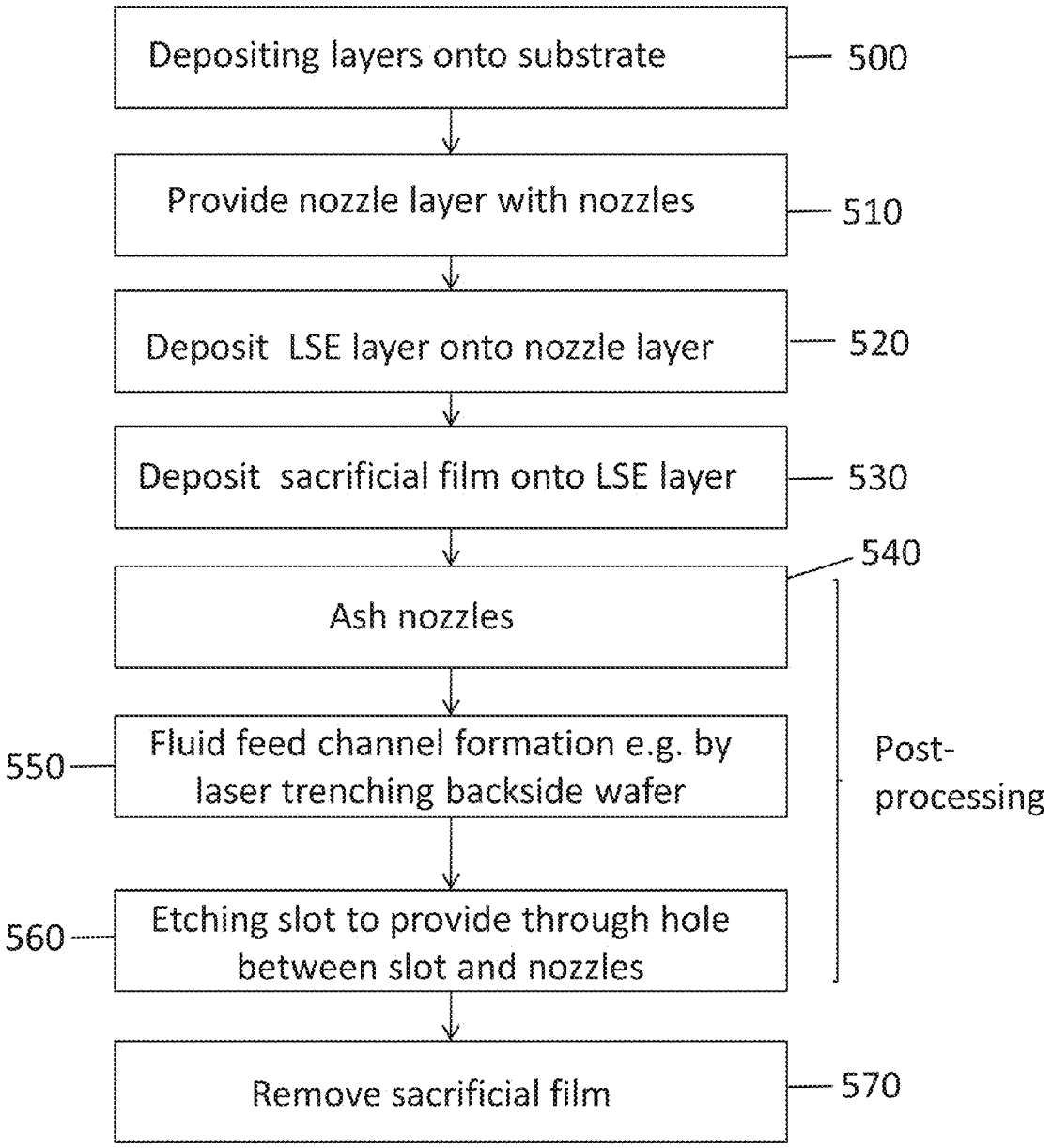
FIG. 5 shows a flow chart of an embodiment of a method of manufacturing a print head.

An embodiment of a method of manufacturing a print head 2 may be explained with reference to FIGS. 3, 4 and 5. FIGS. 3 and 4 show embodiments of intermediate print head portions 2A. FIG. 5 shows a flow chart of an embodiment of a method of manufacture of a print head 2. The method is shown as a series of steps 500-570. It will be clear for the skilled person that, although the method is described with reference to FIG. 5 according to a certain sequence of steps, in other embodiments the order of the steps may be different, particular steps may be excluded, or may be different, or other not shown steps may be included.

In a method step 500, thin film layers 8 and the nozzle layer 3 may be formed on the substrate 9. Thin film layers 8 may be applied through CVD (Chemical Vapor Deposition), PVD (Physical Vapor Deposition), ALD (Atomic Layer Deposition) and/or other suitable deposition techniques. Thin film layer 8 may be grown onto the substrate 9. The resistors 7 may be connected to thin film layers 8. In an embodiment, the intermediate channel 11 may be formed in the at least one thin film layer 8 by wet chemical or gas etching through photo patterned openings. The nozzle layer 3 may be provided on the protective coating 8. The nozzle layer 3 may be applied to the substrate 9 in one or multiple layers. The chambers 6 and nozzles 5 may be formed in a stepwise, layer by layer, manner. The nozzle layer 3 may be applied in one or more steps by any suitable method, for example by spin coating, lamination, and/or a suitable deposition method.

In a next step 510, at least one nozzle 5 and chamber 6 may be formed in the nozzle layer 3. The nozzle layer 3 may be photo-imaged to obtain the respective cavities 5 and 6 for example using photolithography. The nozzle layer 3 may comprise photopositive or photonegative resist material. The nozzles 5 and chambers 6 may be formed by exposing one or more areas of the nozzle layer 3 to UV (ultraviolet) light, followed by removal of the exposed or unexposed areas. The nozzles 5 may be of any suitable size for inkjet printing. The nozzles 5 may for example have a diameter of between approximately 5 and 50 microns.

In a next step 520, the LSE coating 12 may be formed onto the nozzle layer 3. The LSE coating 12 may be coated onto the nozzle layer 3 by any suitable growing or deposition technique or the like, such as lamination, dry coating curtain coating, spin coating, and/or combinations of these and/or other techniques. For example, the thickness of the LSE coating 12 may be between approximately 1 and approximately 10 microns.

The LSE coating 12 may be patterned for leaving open the nozzles 5. The nozzles 5 may be left open by selectively depositing the LSE coating 12 next to the nozzles 5. In one embodiment, an LSE coating 12 may be deposited over the nozzles 5, and afterwards a pressure is applied to the coating 12 so that it opens where the nozzles 5 are. In another embodiment, the openings in the LSE coating 12 may be formed after the nozzles 5 are patterned via exposure and/or before the nozzles 5 have been developed with solvent. In a further embodiment, the nozzles 5 may be formed at the same time through both layers 3, 12, for example by a technique involving photo-imaging. The LSE coating 12 may be applied near the edges of the nozzles 5, and/or over the edges of the nozzles 5, partly within the nozzles 5. In embodiment, the LSE coating 12 may be additionally patterned, i.e. in addition to having openings that correspond to the nozzles 5. The LSE coating 12 may be additionally patterned across the front surface 4 so the coating may be selectively present and missing across the surface 4. The LSE coating 12 may be patterned to separate differently colored inks. In an embodiment, missing LSE coating 12 may provide favorable bonding regions for adhesives.

In a next step 530, a sacrificial film 14 may be deposited onto the LSE coating 12. An intermediate print head 2 with such sacrificial film 14 is shown in FIG. 3. The sacrificial film 14 may be deposited under a relatively low temperature, for example below the glass transition temperature of nozzle layer 3 material and/or the LSE coating 12. Amongst others, this may prevent affecting the nozzle layer 3 and/or the LSE coating 12 by overheating. For example, the sacrificial film 14 may be deposited under a temperature lower than approximately 200° C., for example lower than approximately 180° C., or for example lower than approximately 160° C., for example between approximately 120 and approximately 200° C. In an embodiment, the sacrificial film 14 may be applied through CVD (Chemical Vapor Deposition), or PECVD (Plasma Enhanced CVD). Suitable materials may include silicon nitride, silicon dioxide, and/or silicon oxynitride. In an embodiment, the sacrificial film 14 may be deposited as TEOS (tetraethyl orthosilicate) or USG (undoped silicon glass) under relatively low temperature, such as 170° C., and converted into silicon dioxide. In a further embodiment, the sacrificial film 14 may be applied by PVD (Physical Vapor Deposition). Suitable materials may include silicon nitride, silicon oxide, titanium, titanium nitride, and/or hafnium oxide. In a further embodiment, the sacrificial film 14 may be applied by ALD (Atomic Layer Deposition). A suitable material for the latter technique may include hafnium oxide.

In one embodiment, the sacrificial film 14 is deposited at approximately 170° C., wherein the sacrificial film 14 may include TEOS. In another embodiment, the sacrificial film 14 is deposited at approximately 150° C., wherein the sacrificial film 14 may include silicon nitride. The relatively low deposition temperatures may limit possible damage to an SU8 nozzle layer 3.

The intermediate product 2A, for example as shown in FIGS. 3 and 4, may be post processed, as indicated by steps 540, 550 and 560. In this description, post processing may be understood as processing the substrate 9 after the cavities 5 and 6 have been formed in the nozzle layer 3 and cavity 11 has been formed in the at least one thin film layer 8, wherein the substrate includes the back side 15 and the nozzle layer 3. For example, in a step 540, the nozzles 5 may be ashed, for example by post-barrier ashing and/or dioxide plasma ashing. The ashing may remove residues from the nozzles 5 and/or chambers 6. During ashing, the sacrificial film 14 may inhibit damage to the LSE coating 12 by the ashing process.

In a further step 550, the fluid feed channel 10 may be formed in the substrate 9, as shown by FIG. 4. The fluid feed channel 10 may be formed through the back side 15 of the substrate 9. A first, relatively large part of the fluid feed channel 10 may be formed by a first removal process. In one embodiment, this first removal process may comprise a laser machining process. During the first removal process, the fluid feed channel 10 may be formed through the back side 15, between the backside 15 and the intermediate channel 11, not completely reaching the intermediate channel 11. This may prevent that the first removal process damages the nozzle layer 3 and LSE layer 12, for example due to poor material selectivity of a laser machining process.

As indicated by step 560, a second removal process may connect the fluid feed channel 10 with the nozzles 5, through the intermediate channel 11. The first and second removal process may be referred to as a hybrid slotting process. The second removal process may remove material between the fluid feed channel 10 and the intermediate channel 11 to connect the fluid feed channel 10 with the nozzles 5. The second removal process may comprise removing the material in a direction from the backside 15 of the substrate 9 to the nozzle layer 3. In one embodiment, the second removal process may comprise etching the inside of the fluid feed channel 10 until it opens into the intermediate channel 11. In further embodiments, the second removal process comprises wet or dry etching, for example TMAH (tetramethylammonium hydroxide) wet etching. The sacrificial film 14 may protect the LSE coating 12 during the first and/or second removal process. The sacrificial film 14 may prevent the LSE coating 12 from being damaged by the etch process such as the TMAH wet etching process.

In conventional methods, post processing would negatively affect the initially high contact angle properties of the LSE coating 12. For example, certain ash and etch processes could damage the LSE coating 12 so that the initially high water contact angle of around 100° would decrease to around 40°, as will be explained below with reference to FIG. 6. The sacrificial film 14 may prevent the LSE coating 12 from being affected by post processing techniques, such as ashing and wet etching. By applying the sacrificial film 14, the contact angle of the LSE coating 12 may be maintained closer to 100°. It is noted that next to post processing techniques such as ashing and etching, the sacrificial film 14 may have protective advantages for other substrate processing and post processing techniques, including both mechanical and/or chemical processing techniques.

After the post processing steps 540, 550, 560, the sacrificial film 14 may be removed from the intermediate print head 2A. In one embodiment, the sacrificial film 14 may be removed by applying a foil that adheres to the sacrificial film 14. The foil may comprise a tape or the like. Subsequently the foil may be moved away from the LSE coating 12 while the sacrificial film 14 adheres to the foil. In this way the sacrificial film 14 may be removed from the LSE coating 12, while maintaining a relatively high contact angle of the LSE coating 12.

In another embodiment, the sacrificial film 14 may be removed by applying a chemical etch material that removes the sacrificial film 14 without damaging the LSE coating 12. For example, the etch method may comprise removing the sacrificial film 14 with dilute BOE (Buffered Oxide Etch). Note that in this disclosure "dilute BOE" may be obtained by further diluting standard BOE. Standard BOE may have a volume ratio of, approximately, 6:1 of ammonium fluoride and hydrofluoric acid, respectively. In turn, dilute BOE may be the result of further diluting such "standard" BOE, for example such that there may be between approximately 20 and approximately 50 volume parts of water for each 1 volume part of such standard 6:1 BOE. The temperature of the dilute BOE etch bath may be in the range of 15 to 30 degrees Celsius. The etch time may be determined by the sacrificial film thickness 14 and may for example be in the range of 1 to 20 minutes. The sacrificial film 14 that is removed by BOE may comprise silicon dioxide. While in conventional methods, BOE was applied for removing particles after forming slots in a substrate, BOE has also shown to be suitable for removing the sacrificial film 14 while keeping the LSE coating 12 relatively intact.

In an embodiment, the sacrificial film 14 comprise silicon nitride that is deposited at a temperature of approximately 160° C. or lower, for example approximately 150° C., onto the intermediate print head 2A having a nozzle layer 3 comprising SUB. Thereafter, the silicon nitride may be suitably removed with dilute BOE, or alternatively, by adhering foil.

Next to using a foil or BOE, other methods may also be suitable for removing the sacrificial film 14, for example depending on the type of sacrificial film 14.

Figure 6:
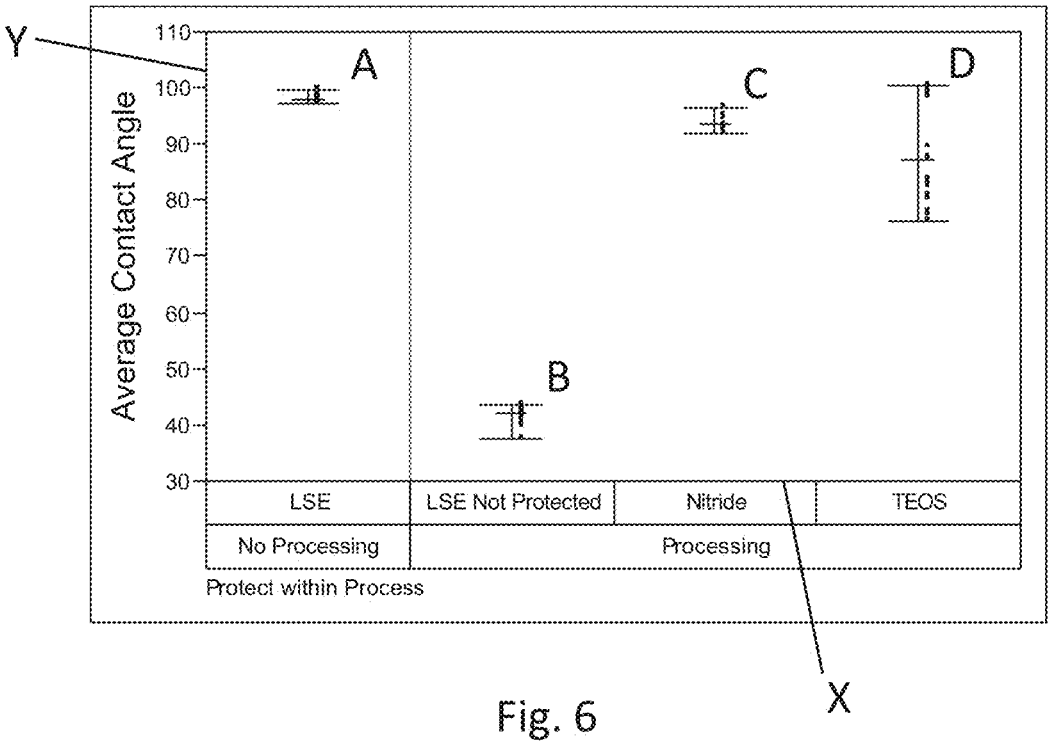
FIG. 6 shows a graph of test results wherein a vertical axis corresponds to the contact angle of the respective LSE coating with water and a horizontal axis plots four different embodiments of processing methods and sacrificial layers corresponding to respective embodiments of print heads.

FIG. 6 shows a graph of test results of the water contact angle of the LSE coating 12 using a sacrificial film 14, as compared to the contact angle of an LSE coating without post processing, and as compared to the contact angle of an LSE coating 12 wherein the nozzle layer 3 has been post processed without sacrificial film 14. Water contact angles are indicated along the vertical axis Y. Along the horizontal axis X, the differently processed and/or differently arranged substrates 9 are indicated.

A group A of test results shows the contact angles for an LSE coating 12 that has not undergone post processing. In the tested embodiments, water contact angles of the LSE coatings without post processing vary between approximately 96° and approximately 100°.

The groups B-D were post processed. The nozzle layer 3 and its cavities 5 and 6 along with the cavity 11 of the at least one thin film layer 8 were ashed and the fluid feed channel 10 was laser trenched and TMAH wet etched.

A second group B of test results relates to contact angles of a similar LSE coating wherein the substrate 9 has undergone post processing and that is not protected by the sacrificial film 14. In the tested embodiment, the water contact angles of the non-protected LSE coating varied between approximately 38° and 45° after post processing.

A third group C of test results corresponds to the contact angles of the LSE coating 12 that is protected by the sacrificial film 14, wherein the sacrificial film 14 comprises silicon nitride, and the substrate 9 was post processed. The test results of this embodiment indicate water contact angles of between approximately 92° and 97°, after removal of the sacrificial film 14.

A fourth group D of test results corresponds to the contact angles of the LSE coating 12 provided with the sacrificial film 14, wherein the sacrificial film 14 comprises silicon dioxide formed by deposition with precursor TEOS, and the substrate 9 was post processed. The test results of this embodiment indicate a water contact angle of between approximately 75° and 100°, after removal of the sacrificial film 14.

The test results A-D confirm the advantages of the use of the sacrificial film 14 for maintaining a high contact angle of the LSE surface 12.

In a first aspect of this disclosure, a manufacturing method for an inkjet print head 2 may be provided, which method may comprise (i) forming a nozzle layer 3 onto a substrate 9, (ii) providing an LSE coating 12 onto the nozzle layer 3, (iii) providing a sacrificial film 14 onto the LSE coating 12, (iv) post processing the substrate 9, and (v) removing the sacrificial film 14 from the LSE coating 12, the LSE coating 12 having a water contact angle of at least 50° after removal of the sacrificial film 14.

In a second aspect of this disclosure, an intermediate inkjet print head 2A may be provided, which may comprise (i) a nozzle layer 3 comprising nozzles, (ii) a LSE coating 12 provided on top of the nozzle layer 3 comprising openings at the nozzles 5, (iii) an LSE coating provided on top of the nozzle layer 3 comprising openings near the nozzles 5 for leaving open the nozzles 5, and (iv) a sacrificial film 14 provided on top of the LSE coating 12, arranged to withstand post processing and to be removed from the LSE coating 12 after said post processing while maintaining a relatively high water contact angle of the LSE coating 12.

In a second aspect of this disclosure, a method of maintaining a relatively high water contact angle of a nozzle surface 4 during manufacture of a print head 2 may be provided. The method may comprise (i) providing a nozzle layer 3 comprising pre-patterned nozzles 5, (ii) providing an LSE (Low Surface Energy) layer 14 on top of the nozzle layer 3, (iii) providing a protective film 14 on top of the LSE coating 12, (iv) ashing the inside of the nozzles 5 while the sacrificial film 14 maintains the water contact angle of the LSE coating 12 above 50°, and removing the sacrificial film 14 from the LSE coating 12.

The above description is not intended to be exhaustive or to limit the invention to the embodiments disclosed. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality, while a reference to a certain number of elements does not exclude the possibility of having more elements. A single unit may fulfill the functions of several items recited in the disclosure, and vice versa several items may fulfill the function of one unit.

The mere fact that certain measures are recited in mutually different dependent claims does not indicate that a combination of these measures cannot be used to advantage. Multiple alternatives, equivalents, variations and combinations may be made without departing from the scope of the invention.

The invention claimed is:

1. Manufacturing method for an inkjet print head, comprising forming a nozzle layer onto a substrate, providing an LSE (low surface energy) coating onto the nozzle layer, providing a sacrificial film onto the LSE coating, post processing the substrate, and removing the sacrificial film from the LSE coating, the LSE coating having a water contact angle of at least 50° after removal of the sacrificial film.

2. Manufacturing method according to claim 1, wherein said water contact angle is within a range of approximately 70° and approximately 120°.

3. Manufacturing method according to claim 1, comprising providing nozzles in the nozzle layer, and post processing the nozzles.

4. Manufacturing method according to claim 3, comprising providing the sacrificial film over the LSE coating, the sacrificial film having openings where the nozzles are.

5. Manufacturing method according to claim 1, wherein the post processing comprises ashing.

6. Manufacturing method according to claim 1, wherein the post processing comprises etching the substrate in a direction from a backside of the substrate to the nozzle layer through the substrate.

7. Manufacturing method according to claim 1, comprising ashing the substrate while the sacrificial film protects the LSE coating, etching the substrate while the sacrificial film protects the LSE coating, and removing the sacrificial film from the LSE coating after which the LSE coating has a water contact angle of 50° or higher.

8. Manufacturing method according to claim 1, wherein the nozzle layer comprises SU8.

9. Manufacturing method according to claim 1, wherein the sacrificial film comprises silicon nitride.

10. Manufacturing method according to claim 1, wherein the sacrificial film comprises silicon dioxide.

11. Manufacturing method according to claim 1, comprising removing the sacrificial film by etching the sacrificial film.

12. Manufacturing method according to claim 1, comprising removing the sacrificial film by applying a foil that adheres to the sacrificial film, and subsequently moving the foil away from the LSE coating while the sacrificial film adheres to the foil so that the sacrificial film is removed from the LSE coating.

13. Intermediate inkjet print head, comprising a nozzle layer comprising pre-patterned nozzles, an LSE coating provided on top of the nozzle layer comprising openings near the nozzles for leaving open the nozzles, and a sacrificial film provided on top of the LSE coating, arranged to withstand post processing and to be removed from the LSE coating after said post processing while maintaining a relatively high water contact angle of the LSE coating.

14. Intermediate inkjet print head according to claim 13, wherein the sacrificial film is arranged to withstand TMAH (tetramethylammonium hydroxide) etch, and be removed by buffered oxide etch.

15. Method of maintaining a relatively high water contact angle of a nozzle surface during manufacture of the print head, comprising providing a nozzle layer comprising pre-patterned nozzles, providing an LSE (Low Surface Energy) coating on top of the nozzle layer, providing a protective film on top of the LSE coating, ashing the inside of the nozzles while the sacrificial film maintains the water contact angle of the LSE coating above 50°, and removing the sacrificial film from the LSE coating.

* * * * *